United States Patent [19]

Yamazaki et al.

[11] Patent Number: 4,641,794

[45] Date of Patent: Feb. 10, 1987

[54] WIRE ACCUMULATOR

[75] Inventors: Takashi Yamazaki; Katsuji Sakamoto, both of Kanagawa, Japan

[73] Assignee: Sumitomo Electric Industries, Ltd., Osaka, Japan

[21] Appl. No.: 669,153

[22] Filed: Nov. 7, 1984

[30] Foreign Application Priority Data

Nov. 8, 1983 [JP] Japan ..... 58-210572

[51] Int. Cl.[4] ..... B65H 51/22

[52] U.S. Cl. ..... 242/47.01; 242/25 R; 242/47.09; 242/47.12

[58] Field of Search ..... 242/47.01, 47.08, 47.09, 242/47.1, 47.11, 47.12, 47.13, 47, 25 R, 78, 82

[56] References Cited

U.S. PATENT DOCUMENTS

| | | | |
|---|---|---|---|
| 2,165,259 | 7/1939 | Helm | 242/47.1 |
| 2,755,916 | 7/1956 | McIlvried et al. | 242/47.12 |
| 3,017,130 | 1/1962 | Knight et al. | 242/47.09 |
| 3,078,055 | 2/1963 | Harris | 242/47.12 |
| 3,099,412 | 7/1963 | Nystrom | 242/47.01 |
| 3,241,780 | 3/1966 | Kitselman | 242/47.12 |
| 3,891,155 | 6/1975 | Naegeli | 242/47.12 X |

FOREIGN PATENT DOCUMENTS

| | | | |
|---|---|---|---|
| 96833 | 12/1983 | European Pat. Off. | 242/47.01 |
| 1084798 | 7/1960 | Fed. Rep. of Germany | 242/47.11 |
| 857512 | 4/1940 | France | 242/47.09 |

*Primary Examiner*—Stanley N. Gilreath
*Attorney, Agent, or Firm*—Sughrue, Mion, Zinn, Macpeak & Seas

[57] ABSTRACT

An accumulator wherein the peripheral speeds of separate, accumulating guide roller assemblies are caused by respective independent mechanical arrangements to coincide with the take-up speeds of first and second take-up devices. Using this arrangement, the speed of the optical fiber being accumulated is always equal to the peripheral speed of the accumulating guide rollers so that there is no instantaneous tension change that would otherwise result from a backlash of interconnecting gears.

4 Claims, 6 Drawing Figures

WIRE ACCUMULATOR

BACKGROUND OF THE INVENTION

This invention pertains in general to the art of wire or filament manufacture. Specifically, the invention is a wire accumulator for use in a wire or filament manufacturing facility, particularly for a wire or filament having low tensile strength and which is therefore easily broken, such as, for example, an optical fiber.

A typical manufacturing facility may include a machine for drawing an optical fiber, a first take-up device downstream of the drawing machine, a tensile strength testing machine for testing the tensile strength of the optical fiber during its travel, and a winding device for winding the optical fiber on a bobbin. Optical fibers are relatively weak filament and are therefore easily broken in the tensile strength testing machine. It is, therefore, usual to provide an accumulator and a second take-up device between the first take-up device and the tensile strength testing machine to facilitate replacement of the, optical fiber without stopping the drawing machine if the fiber is broken. Commonly assigned U.S. application with Ser. No. 502,059 filed on June 7, 1983, now abandoned, is directed to such an accumulator. The invention set forth in this application is a further improvement over this accumulator.

Referring now to FIGS. 1–4 there is shown a known accumulator. Optical fiber 1 is drawn into the accumulator at a constant speed from a drawing machine (not shown) by a first take-up device 2, past guide rollers 17 and to a second take-up device 9 via dancer rollers 11 which control the speed of optical fiber on the second take-up device. From second take-up device 9, the fiber is subjected to a tensile strength test by a tensile testing machine 27, and wound by a winder (not shown) downstream of dancer rollers 28 which control the winding speed, as shown by arrows in FIG. 1. The accumulator includes two groups Y and Z of cylindrical accumulating guide rollers 3 and 3' which are rotatably supported on bearings 5 and shafts 6 and 6' secured at equal intervals in a circular array to side plates 7 and 8, and 7' and 8', respectively, as shown in FIGS. 1 and 2. Each guide roller 3 and 3' is formed around its outer periphery with a plurality of grooves 4 which are equally spaced apart from one another at a pitch P. The grooves 4 on the guide rollers 3 or 3' are slightly displaced axially from one guide roller to another, as shown in FIG. 2. A shaft 14 extending through the center of the guide roller assembly Z is rotatably supported by bearings 12 on a stand 10. A variable speed motor 13 is provided at one end of the shaft 14 for driving it, and an arm 15 is secured to the other end of the shaft 14. A guide bar 16 is secured to the outer end of the arm 15. Moving blocks 18 and 18' are slidable transversely along the guide bar 16 as shown in FIG. 3. Guide rollers 17 and 17' for distributing optical fiber to the accumulating guide roller assemblies Y and Z are rotatably carried on the blocks 18 and 18', respectively. A screw shaft 21 is rotatably supported by bearings 20 on the support members 19 and 19' secured to the opposite ends of the guide bar 16 and the arm 15, and extends in parallel to the guide bar 16. The screw shaft 21 has threaded portions 22 and 23 on both sides of the arm 15, and they are fastened to the moving blocks 18 and 18' by nuts. Threaded portion 22 has a right-hand screw, and threaded portion 23 a left-hand screw. Each screw has a pitch which is equal to pitch P of the grooves 4 on the guide rollers 3 and 3'. Thus, each rotation of the screw shaft 21 causes the movement of the moving blocks 18 and 18' in opposite directions by a distance equal to the pitch of the grooves 4. A timing belt pulley 24 is provided on screw shaft 21 and connected by a timing belt 26 to a timing belt pulley 25 provided on the side plate 7 of the guide roller assembly Y coaxially with the shaft 14, as shown in FIGS. 1 and 4. The two timing belt pulleys have a rotation ratio of 1:1.

If the optical fiber drawing machine is in normal operation, optical fiber passes through the first take-up device 2, the distributing guide rollers 17 and 17', the second take-up device 9 and the tensile testing machine 27 without winding about rollers 3 and 3', and is wound on the winder (not shown), as shown by the arrows in FIG. 1.

If the optical fiber is broken in the tensile testing machine 27, the second take-up device gradually reduces its speed, and simultaneously, the variable speed motor 13 is driven to rotate the shaft 14 in the direction of an arrow R in FIG. 1. The rotation of the shaft 14 causes the rotation of the arm 15 and the distributing guide rollers 17 and 17' about the accumulating guide roller assemblies in the direction of an arrow Q in FIG. 4 thereby winding and accumulating optical fiber on the accumulating guide roller assemblies. As the timing belt pulley 25 on the side plate 7 and the timing belt pulley 24 on the screw shaft 21 are connected to each other by the timing belt 26, the screw shaft is caused to rotate relative to the blocks 18 and 18' in the direction of an arrow T in FIG. 1 by the same angular distance as that of the rotation of the shaft 14. As a result, screws 22 and 23 cause the right-hand movement of the distributing guide roller 17 and the left-hand movement of the guide roller 17'. As the pitch of the screws is equal to that of the grooves on the accumulating guide rollers, the rotation of the shaft 14 results in the orderly distribution, winding and accumulation of optical fiber in the grooves 4 of the accumulating guide roller assemblies. The second take-up device, which has gradually reduced its speed, reaches stability at a constant speed. Optical fiber is withdrawn at a low speed and guided manually to the winder through the tension testing machine. The rotating speed of the variable speed motor 13 is adjusted so that the difference in take-up speed between the first and second take-up devices may effect accumulation of optical fiber. When the apparatus is brought back to its normal operating condition, the second take-up device is rotated at a higher speed than the first take-up device and motor 13 is rotated in the opposite direction, so that optical fiber may be released from the accumulator. The speed of the optical fiber leaving the second take-up device is, therefore, the sum of the take-up speed of the first take-up device and the speed of the optical fiber released from the accumulator. If all of the accumulated optical fiber has been released, the speed of the second take-up device is lowered to coincide with that of the first take-up device, i.e., of the drawing machine. Thus, any breakage of optical fiber in the tensile testing machine can be rectified without lowering the speed of the drawing machine or stopping it.

The apparatus as hereinabove described has, however, a number of disadvantages. As the shafts 6 and 6' for the accumulating guide rollers 3 and 3' are fixed, the bearings 5 are subjected to a high degree of frictional resistance, and as the guide rollers for accumulating optical fiber are caused by the optical fiber to rotate at a speed coinciding with the traveling speed of the optical fiber to be accumulated, the guide rollers impose on the optical fiber an increased tension which may result in breakage, or a worsening of its properties even if it may not be broken. Moreover, the inertia of the guide roller causes a change in the tension of the optical fiber whenever the rotating speed of the guide rollers is varied.

FIG. 5 shows an improved accumulator. The accumulating guide rollers are fixed to shafts 6 and 6'. The guide roller assembly Y is rotated by timing belts 35 and 37 via timing belt pulleys in such a way that the peripheral speed of the grooves on the rollers may coincide with the speed of the optical fiber on the first take-up device 2. The shafts 6' for the guide roller assembly Z are driven as a result of operation by a differential gear assembly 42 on the speed of optical fiber on the first take-up device and the speed of accumulation by the rotation of the arm 14. Thus, the peripheral speeds of the guide roller assemblies Y and Z are always maintained equal to the speed of optical fiber traveling past them.

As the FIG. 5 arrangement uses a differential gear unit, its backlash creates an instantaneous speed change in the guide roller assembly Z and it causes a change in the tension of a wire or filament on the distributing guide rollers. As the accumulator comprises a plurality of guide rollers equally spaced apart from one another in a circular array, the wire or filament which is accumulated has a polygonal shape, and therefore, the wire or filament on the distributing guide rollers is subjected to the same number of pulsing speed changes as that of the sides of the polygon during each rotation about the accumulator when it is accumulated or released. This causes a change in the tension of the wire or filament on the distributing guide rollers.

It is necessary to prevent such tension changes from occurring when the manufacturing process requires the maintenance of a low tension which does not make any appreciable change. The conventional system employs electrical control by the variable speed motor 13 of the speed of the optical fiber to be accumulated or released, and also requires the electrical control of the take-up speed of the second take-up device 9. An error is likely to develop between these two kinds of control. The correction of this error requires a complicated system, as it is necessary to correct the speed of the second take-up device 9 by the speed control dancer rollers 11.

SUMMARY OF THE INVENTION

The present invention solves this tension change problem. According to this invention, the accumulating guide roller assembly Z is mechanically connected to the second take-up device so that the surface velocity of the assembly Z may coincide with the take-up speed of the second take-up device. Tension and speed control means, such as dancer rollers, are provided between the distributing guide rollers 17 and 17' to maintain the optical fiber at a constant tension and to detect the length (or amount) of optical fiber therebetween. The tension and speed control means transmits a signal to the variable speed motor to correct the speed of optical fiber to be accumulated or released, or to a driving system for the second take-up device to correct its speed. These arrangements make it possible to prevent any tension change that might otherwise arise from the inertia and polygonal arrangement of the accumulating guide rollers, and thereby enable optical fiber to be accumulated or released properly.

The accumulator of this invention differs from the above-described apparatus in that the peripheral speeds of the accumulating guide roller assemblies Y and Z are always caused by mutually independent mechanical connections to coincide with the take-up speeds of the first and second take-up devices, respectively, when optical fiber is wound for accumulation on the accumulator by the distributing guide rollers rotating coaxially with the accumulator. Therefore, the speed of the optical fiber being accumulated is always equal to the peripheral speed of the accumulating guide rollers, and there is no instantaneous tension change that might otherwise result from the backlash of the interconnecting gears. The optical fiber is accumulated at a constant tension, since the take-up speed of the second take-up device or the speed of the optical fiber accumulation is finely controlled in accordance with a control signal transmitted by the tension and speed control device provided in the passage for the optical fiber between the distributing guide rollers. The accumulating capacity of the tension and speed control device absorbs any tension change caused by the polygonal arrangement of the accumulating guide rollers. Thus, the accumulator of this invention is very effective for use with a drawing machine for producing a wire or filament having a low tensile strength and which may be easily broken, such as optical fiber.

BRIEF DESCRIPTION OF THE DRAWINGS

The invention will now be described in detail with reference to the drawings.

DETAILED DESCRIPTION OF THE PREFERRED EMBODIMENT

Figure 1:
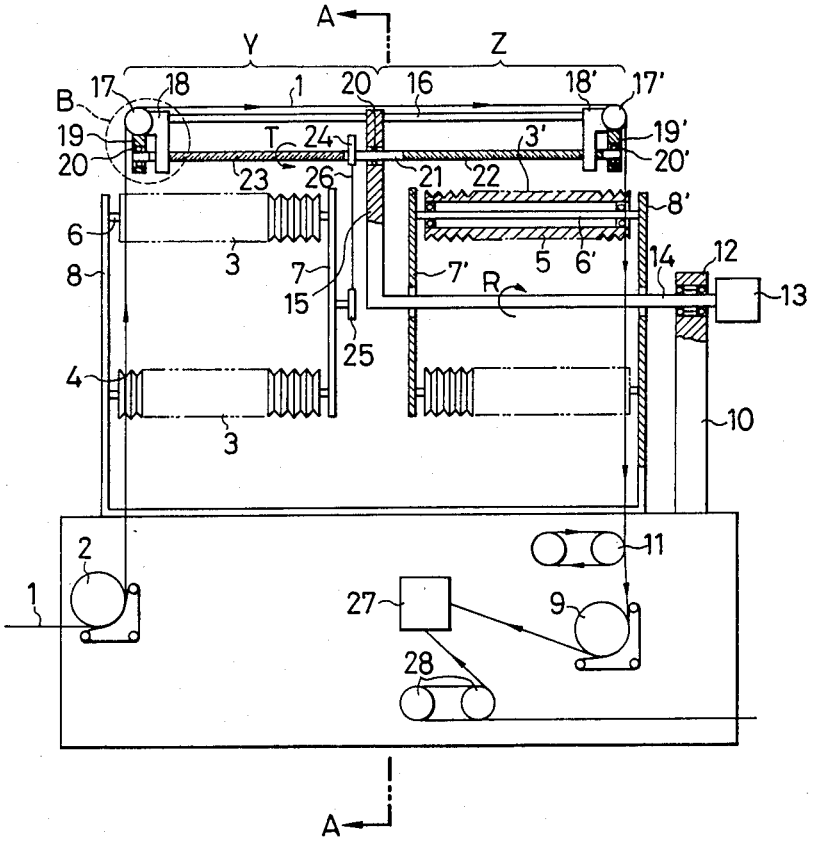
FIG. 1 is a front elevational view of a first type of accumulator.
Figure 2:
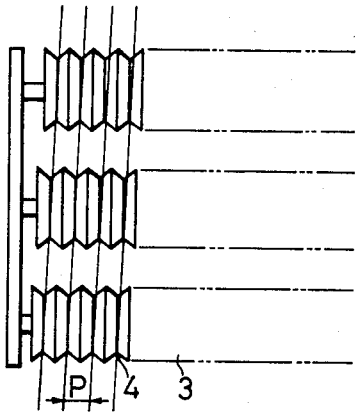
FIG. 2 is a front elevational view showing the arrangement of accumulating guide rollers.
Figure 3:
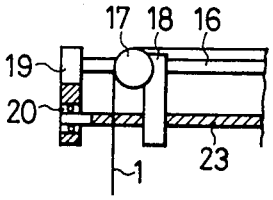
FIG. 3 is a detailed view of a portion designated at B in FIG. 1.
Figure 4:
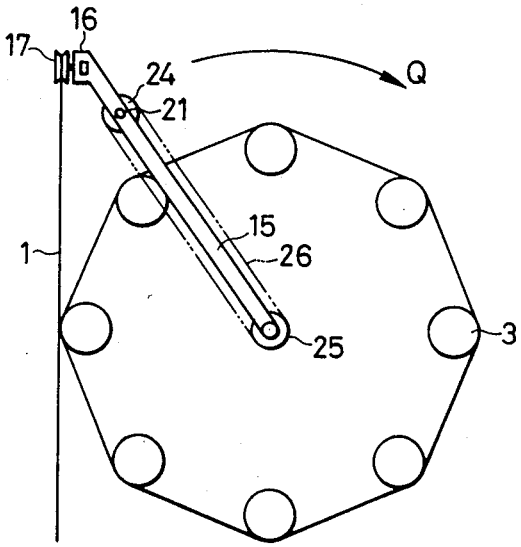
FIG. 4 is a sectional view taken along the line A—A of FIG. 1.
Figure 5:
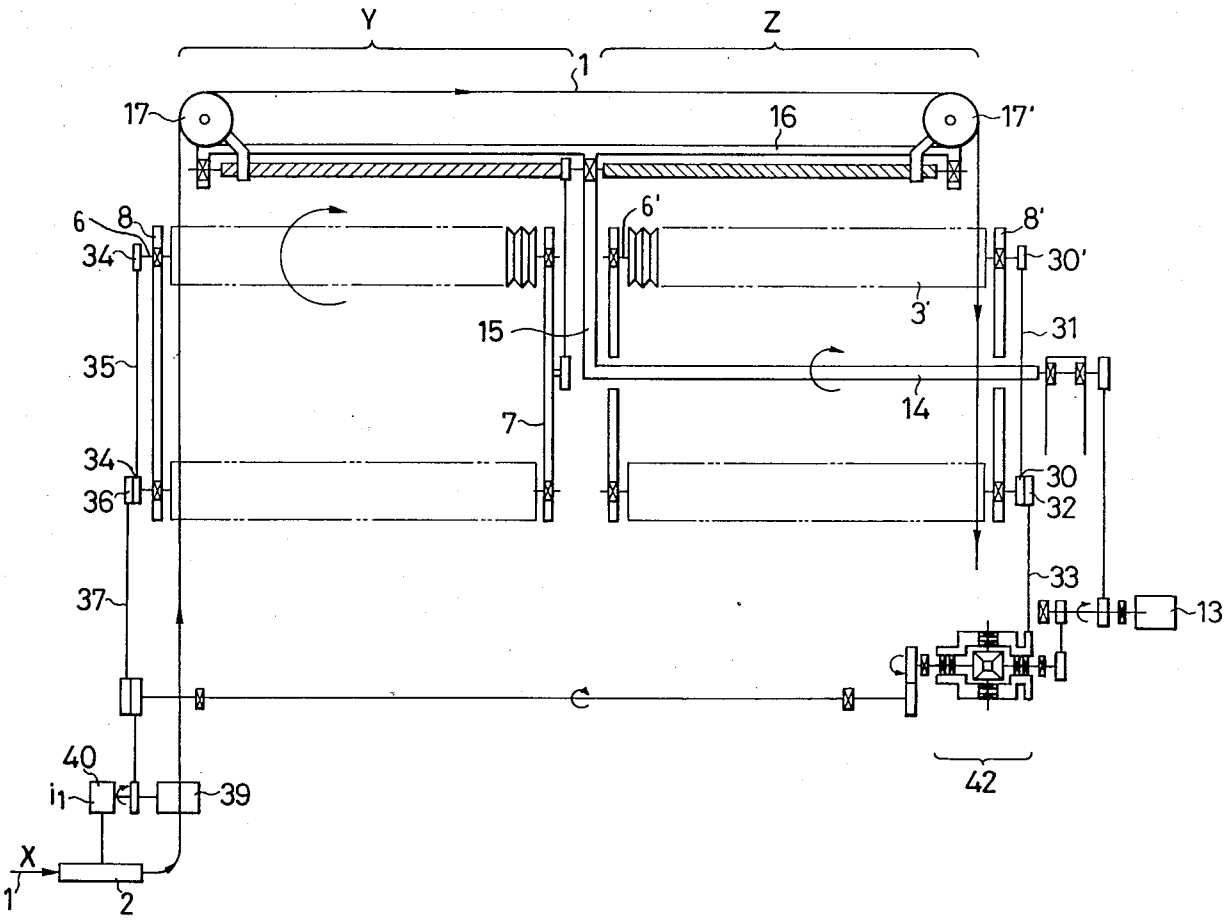
FIG. 5 is a diagram showing a driving system for another accumulator.
Figure 6:
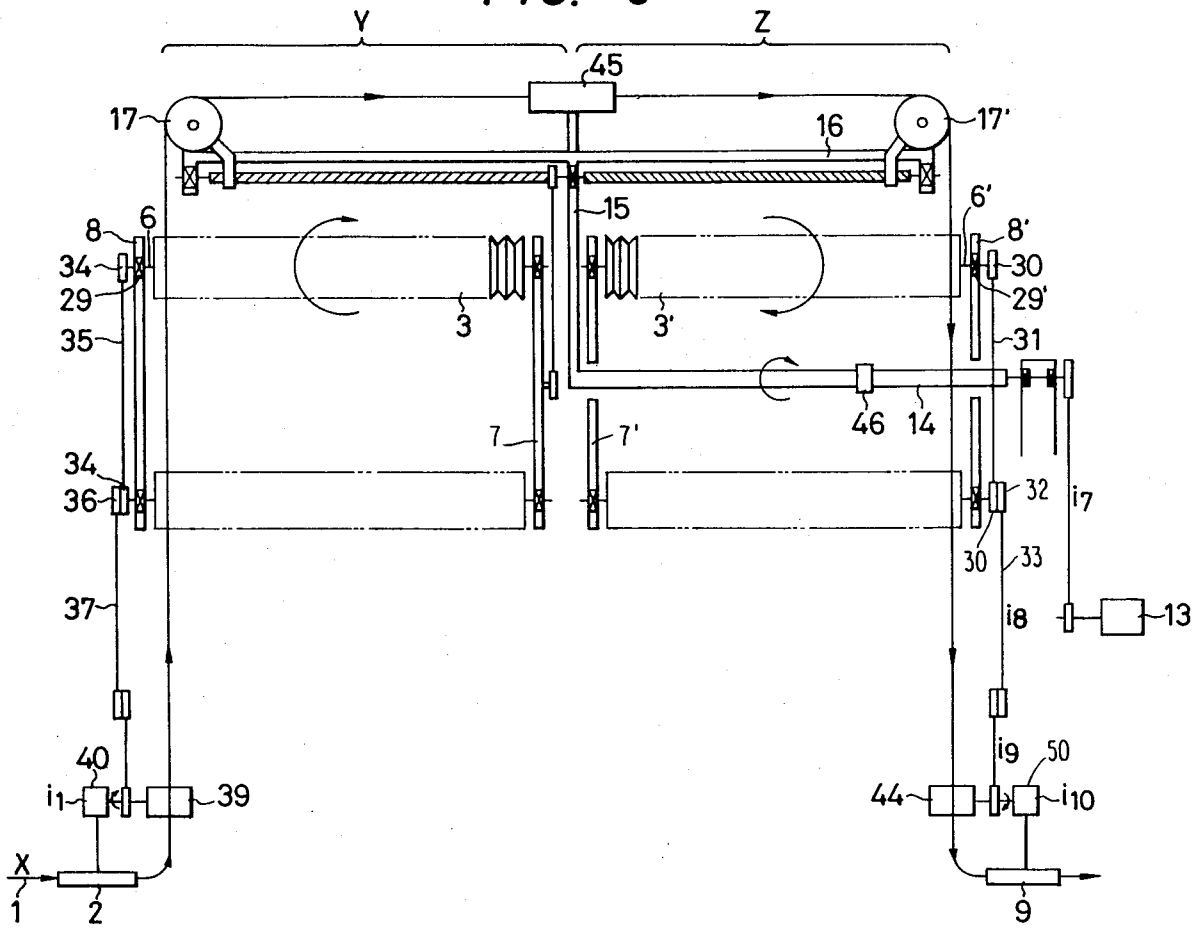
FIG. 6 is a diagram showing a driving system for an accumulator embodying this invention.

FIG. 6 is a front elevational view of a preferred embodiment of this invention. Like reference numerals are used to designate parts that are like or corresponding to those of the other FIGURES.

Accumulating guide rollers 3 and 3' are fixed to the shafts 6 and 6' supported rotatably by bearings 29 and 29' on the side plates 7, 7', 8 and 8'. Timing belt pulleys 34 of the same size are provided on one end of each shaft 6 in the guide roller assembly Y, and are connected by a single timing belt 35 so that all of the guide rollers are able to rotate at the same speed in the same direction. A timing belt pulley 36 is provided on one of the shafts 6, and driven by a driving timing belt 37. The timing belt 37 is driven from the shaft of a variable speed motor 39 which drives the first take-up device 2 through a speed changer 40 having speed change ratio $i_1$.

Timing belt pulleys 30 of the same size are provided on the opposite end of each shaft 6' in the guide roller assembly Z, and are connected by a single timing belt 31 so that all of the guide rollers are able to rotate at the same speed in the same direction. A timing belt pulley 32 is provided on one of the shafts 6' and is driven by a driving timing belt 33 which is connected to the shaft of a variable speed motor 44 which drives the second take-up device 9 through a speed changer 50 having a constant speed change ratio i10. The timing belt pulley 32 is designed to provide the timing belts with a transmission ratio of i8 and i9 to enable the peripheral speed of the grooves on the guide rollers 3' to coincide with the take-up speed of the second take-up device 9. Although two timing belt transmissions i8 and i9 are shown, it is, of course, possible to employ only a single transmission if it provides the same transmission ratio. It is also possible to use any connecting means other than the timing belts if it enables transmission at an accurate speed ratio.

The arm 15 is secured to the end of the shaft 14 extending through the center of the guide roller assembly Z and is driven by the variable speed motor 13. The distributing guide rollers 17 and 17' are transversely movably provided on the end of the arm 15 to accumulate the wire or filament on the accumulating guide rollers. Tension and speed control means 45, such as dancer rollers, are provided between the distributing guide rollers 17 and 17'. As shown, the tension and speed control means may be mounted on the arm 15 and guide bar indicated at reference numberal 16. A signal representing the displacement of the dancer roller or like means is transmitted through the arm 15 and picked up through a slip ring 46 provided on the shaft 14.

The operation of the apparatus will be described with reference to FIG. 6. When the apparatus is in its normal operating condition, the optical fiber leaving the drawing machine passes through the wheel of the first take-up device 2 which is driven by the motor 39 via the speed changer 40, the distributing guide roller 17, the tension and speed control device 45, the distributing guide roller 17' and the wheel of the second take-up device 9.

If it has become necessary to accumulate optical fiber, the speed of the second take-up device 9 is changed, and the shaft 14 and the arm 15 are driven by the motor 13 to drive the distributing guide rollers 17 and 17' so that optical fiber may be wound on the accumulating guide roller assemblies Y and Z. The variable speed motors 13 and 44 are controlled to ensure that the winding or unwinding speed $V_3$ is always equal to the take-up speed $V_1$ of the first take-up device 2 less the take-up speed $V_5$ of the second take-up device 9.

According to the arrangement hereinabove described, the peripheral speed $V_2$ of the guide roller assembly Y is always equal to the take-up speed $V_1$ of the first take-up device 2, as they are mechanically connected to each other, and the peripheral speed $V_4$ of the guide roller assembly Z is always equal to the take-up speed $V_5$ of the second take-up device 9, as they are mechanically connected to each other. It follows that the speed of the optical fiber accumulated on the guide rollers is always equal to the peripheral speed of the bottom of the grooves on the guide rollers. Thus, there is no sliding of the optical fiber relative to the guide rollers. There is, therefore, no tension created by the friction between the optical fiber and the guide rollers.

A difference is likely to arise between the take-up speed $V_5$ of the second take-up device 9 and the speed $V_3$ of accumulation of the variable speed motor 13, as they are controlled from an external source. The difference is, however, detected by way of the displacement of the dancer roller or like control means 45 between the distributing guide rollers 17 and 17', and a signal is picked up through the slip ring 46 on the shaft 14 to correct the external control of the motors 13 and 44. This enables the optical fiber to be accumulated without loosening or being unduly stretched. It is, of course, effective to make such correction for either of the motors 13 and 44. The tension and speed control device 45 maintains the optical fiber at a constant tension and as it has some accumulating capacity, it absorbs any slight changes in the speed of optical fiber that is due to the polygonal arrangement of the accumulating guide rollers. The device 45 is preferably of the construction not creating any tension change by centrifugal force as it is positioned for rotation about the accumulating guide rollers.

Other embodiments and modifications of the present invention will be apparent to those of ordinary skill in the art having the benefit of the teaching presented in the foregoing description and drawings. It is, therefore, to be understood that this invention is not to be unduly limited and such modification are intended to be included within the scope of the appended claims.

What is claimed is:

1. A wire accumulator, comprising:

first and second coaxially disposed assemblies of accumulating guide rollers having equally pitched grooves;

first and second drive means for respectively rotatably driving said accumulating guide rollers;

a shaft extending through one of said assemblies;

guide bar means rotatable with said shaft so as to orbit about said assemblies;

a first variable speed motor for rotating said shaft;

distributing guide rollers movably mounted on said guide bar means and orbited about said assemblies by said first variable speed motor, for winding a traveling wire on said assemblies or unwinding said wire therefrom;

a first take-up device driven by said first drive means for receiving said wire from a source thereof;

a second take-up device driven by said second drive means for delivering said wire;

means for rotationally interconnecting said first assembly, said first drive means and said first take-up device so that a wire take-up speed of said first take-up device is equal to a peripheral speed of said accumulating guide rollers of said first assembly;

means for rotationally interconnecting said second assembly, said second drive means and said second take-up device so that a wire take-up speed of said second take-up device is equal to a peripheral speed of said accumulating guide rollers of said second assembly;

a tension and speed control device provided between said distributing guide rollers for transmitting a tension and speed control signal; and means, responsive to said signal, for controlling the orbital speed of said distributing guide rollers around said assemblies or the speed of rotation of said second set of accumulating guide rollers in accordance therewith.

2. An accumulator as set forth in claim 1, wherein said tension and speed control device comprises a dancer roller provided with a displacement detector.

3. An accumulator as set forth in claim 1, wherein said second drive means comprises a second variable speed motor, and wherein said means responsive to said signal comprises means for controlling the speed of one of said first and second variable speed motors.

4. An accumulator as set forth in claim 2, wherein said second drive means comprises a second variable speed motor, and wherein said means responsive to said signal comprises means for controlling the speed of one of said first and second variable speed motors.

* * * * *